United States Patent [19]

Booth

[11] 4,226,196

[45] Oct. 7, 1980

[54] TUFTING MACHINES

[75] Inventor: David Booth, Brighouse, England

[73] Assignee: Firth Carpets Limited, Brighouse, England

[21] Appl. No.: 27,720

[22] Filed: Apr. 6, 1979

[30] Foreign Application Priority Data

Apr. 14, 1978 [GB] United Kingdom ..... 14698/78

[51] Int. Cl.[2] ..... D05C 15/00

[52] U.S. Cl. ..... 112/79 R; 112/163

[58] Field of Search ..... 112/79 R, 79 FF, 79 A, 112/167, 163, 155

[56] References Cited

U.S. PATENT DOCUMENTS

| | | | |
|---|---|---|---|
| 2,889,791 | 6/1959 | Fedevich | 112/79 R |
| 3,396,687 | 8/1968 | Nowicki | 112/79 A |
| 3,402,686 | 9/1968 | Rodstein | 112/79 R |

FOREIGN PATENT DOCUMENTS

| | | | |
|---|---|---|---|
| 1324649 | 7/1973 | United Kingdom | 112/79 A |

*Primary Examiner*—Ronald Feldbaum
*Attorney, Agent, or Firm*—Diller, Ramik & Wight

[57] ABSTRACT

A sliding needle bar tufting machine is provided with two needle bars each carrying a single row of needles, at least one needle bar being mounted to be adjustable in a warpwise direction relative to the other needle bar to enable the spacing between the two rows of needles to be varied. In an alternative construction a needle bar is arranged at each side of a needle bar carrier and both needle bars are adjustable along a common support member mounted in the carrier.

9 Claims, 3 Drawing Figures

TUFTING MACHINES

DESCRIPTION

This invention concerns tufting machines and relates more particularly to so-called sliding needle bar tufting machines by means of which, during manufacture, a pattern is incorporated in a tufted textile fabric such as a carpet fabric.

Generally, in a tufting machine, the needles which carry the yarn into the backing fabric are mounted in a needle bar which extends transversely across the machine and in early machines, no pattern was obtainable in the finished carpet other than stripes or bands extending in the warp direction, which could be produced by the use of different coloured yarns; or mottled or tweed effects which resulted, for example, if stippled yarns were employed. In later machines, zig-zag lines or bands were produced by introducing relative lateral movement between the backing fabric and the needle bar, a movement which in modern machines is produced by mounting the needle bar to be slidable and by reciprocating the slidable needle bar. Considerable variation in the resulting simple zig-zag patterns may be achieved by using a cam to effect the reciprocating movement, the cam having a profile predetermined to move the needle bar laterally in directions, to extents and at times which are calculated, in co-operation with the various yarns carried by the needles, to produce a required pattern; and such patterns may be still further varied by providing the needle bar with two rows of needles rather than with a single row, the two rows of needles typically being separated slightly from one another in a warpwise direction. However, all patterns produced essentially solely by lateral displacement of the needle bar are of a small geometric nature and even with the employment of two rows of needles on the needle bar the range of sizes of design obtainable in practice are strictly limited.

According to the present invention a tufting machine is provided with two needle bars or equivalent members, each carrying a single row of needles, and said needle bars or equivalent members are mounted to permit adjustment in a warpwise direction of the spacing between the two rows of needles.

By enabling adjustment to be made in the spacing of the needle rows, the invention thus permits:

(a) an increase in the size of the pattern warpwise, and (b) it allows the use of wider yarn "plants" resulting in an increase of the size of the pattern weftwise. Put another way, the invention enables the pattern to be "opened out" both in the warp and the weft direction and this is found in practice to considerably increase the overall pattern variations that may be achieved.

The invention will be described further, by way of example with reference to the accompanying generally diagrammatic drawings, in which.

Figure 1:
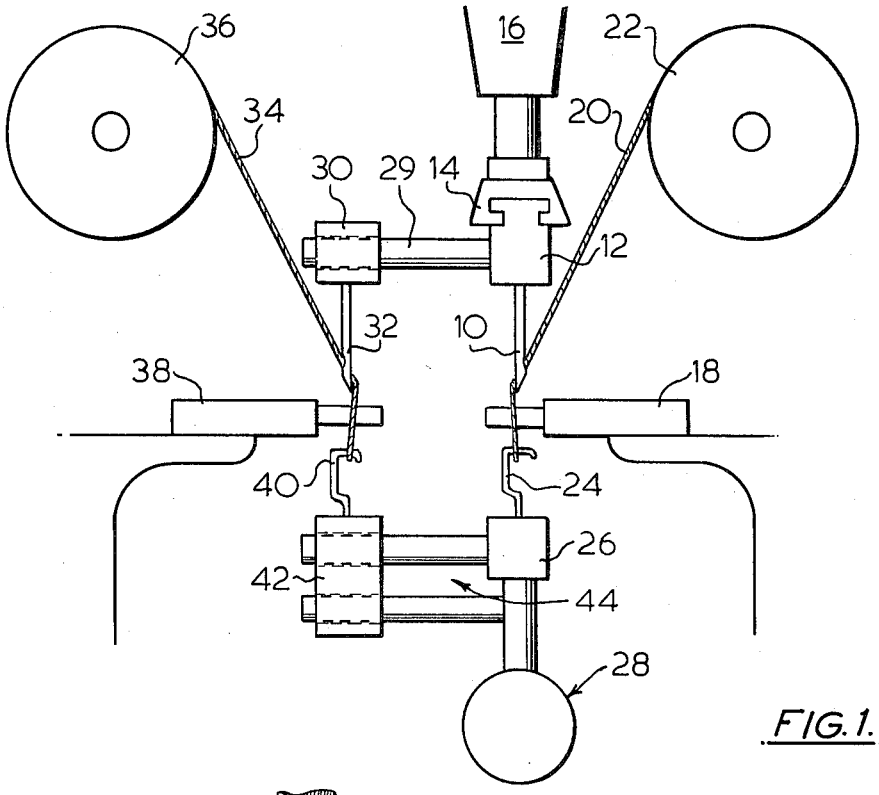
FIG. 1 is a vertical section through the needle bar and looper region of a tufting machine embodying the invention.
Figure 2:
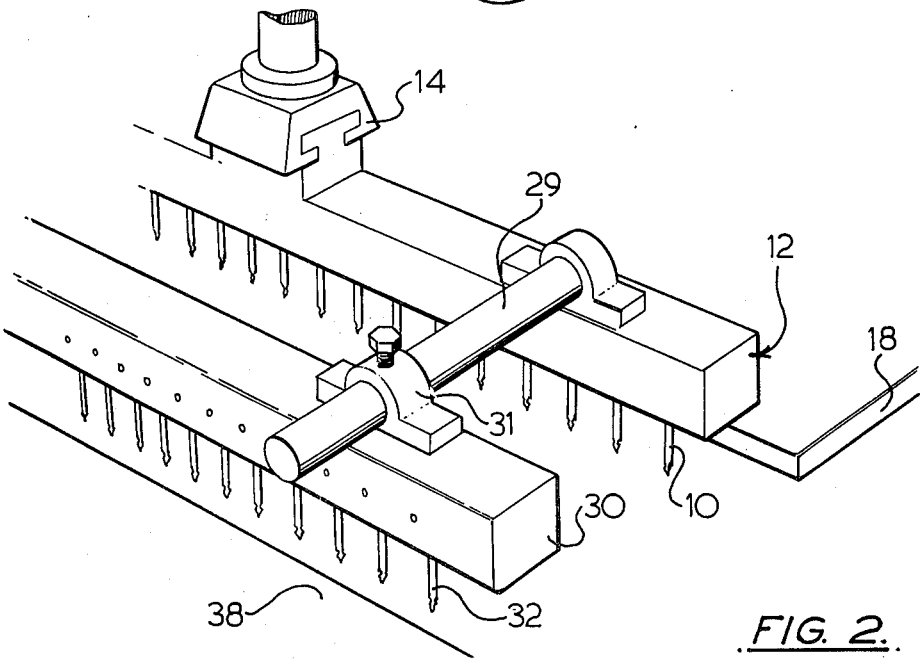
FIG. 2 is a top perspective view thereof.

As shown in FIGS. 1 and 2 of the drawings, a row of needles 10 depends from a needle bar 12 mounted slidably in a carrier 14 which is vertically reciprocable by a mechanism 16 of any convenient conventional construction. Conventional means (not shown) may be provided for effecting lateral displacement of the needle bar 12 (that is to say into and out of the plane of the paper as viewed in FIG. 1) responsive to pattern requirements. The usual reed plates or similar members are illustrated at 18 and yarn 20 fed from a creel 22 to the needles 10 is taken by them to a position below the reed plates 18 at which the yarn is engaged by loopers 24. The loopers 24 are mounted in a bar 26 to which an appropriate looping movement is imparted by a rocket shaft assembly 28.

To make provision for a second row of needles, the needle bar 12 carries a number of horizontal, cantilever support members 29 extending in the warp direction, one only of which is visible in the drawings and has adjustably mounted on it, a second needle bar 30 having needles 32 depending from it. A screw clamp 31 is provided to secure the needle bar 30 in its adjusted position. Yarn 34 is fed to the needles from a creel source 36 and is presented below a co-operating reed plate 38 to loopers 40 mounted in a bar 42. In a manner similar to the needle bar 30, the looper bar 42 is adjustably mounted on a support assembly 44.

The warpwise adjustment of the spacing between the rows of the tufting needles 10 and 32 which is made possible by the adjustable mounting of the needle bar 30 on its cantilever support members 29, together with the corresponding adjustability of the looper spacing, thus enable pattern variations to be achieved which are not possible with fixed rows of needles and which can be combined with the pattern variations already available from lateral displacement of the sliding needle bar to produce many unusual and distinctive effects in the manufactured carpet.

Figure 3:
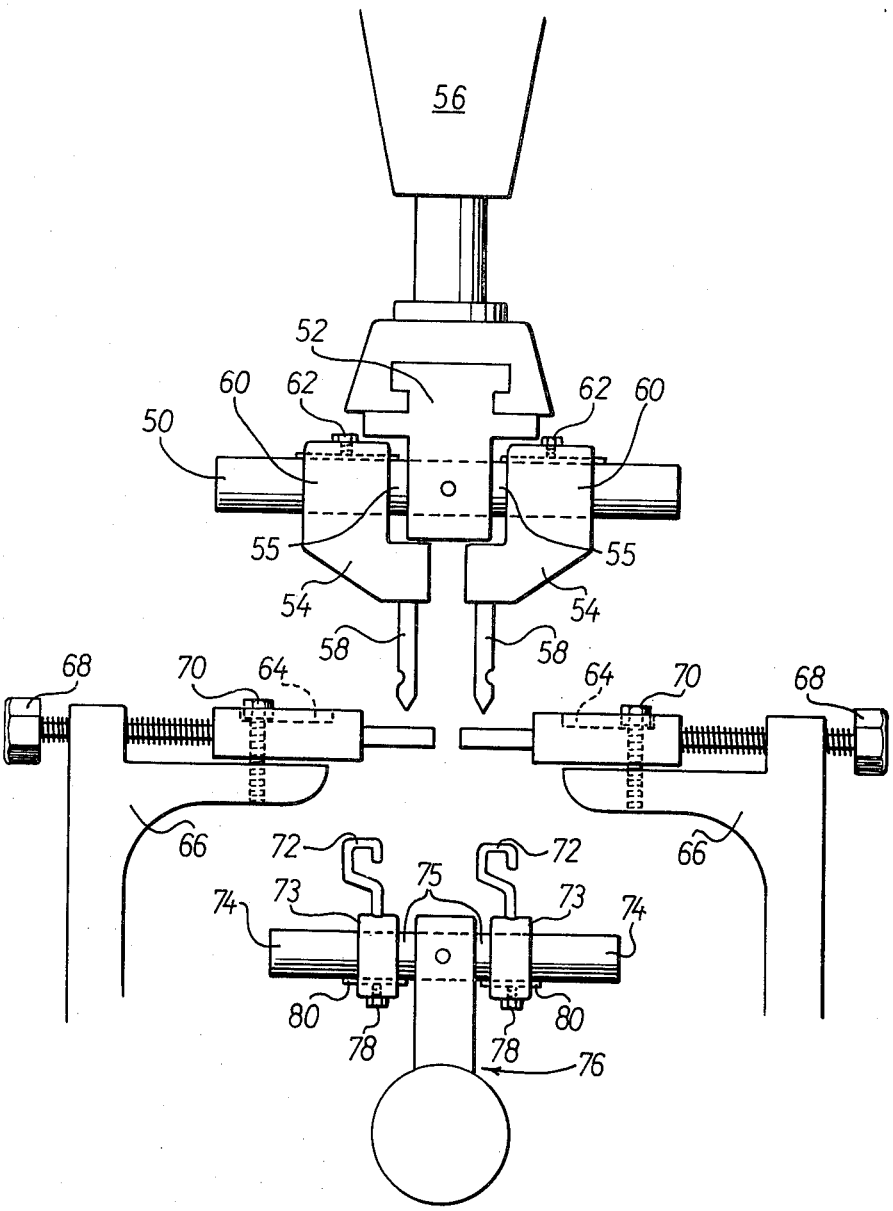
FIG. 3 is a view, similar to that of FIG. 1, of an alternative construction of tufting machine.

In the embodiment illustrated in FIG. 3, a horizontal needle bar support member 50 located in a carrier 52 has mounted upon it, a pair of adjustable needle bars 54 which are positioned symmetrically on either side of the carrier 52. The latter is vertically reciprocable by a conventional mechanism 56. Such needle bar 54 has a row of depending needles 58 supplied with yarn as generally previously described and at positions opposed to the needles 58, the needle bars have apertured suspension lugs 60 or equivalent means by which they slidably engage on the support member 50. Each suspension lug is provided with a clamping screw 62 by which it may be secured relative to the support member 50 and, if desired, a clamping plate may be interposed between the screw 62 and the support member.

Slotted reed plates 64 adjustably supported on brackets 66 are slidably displaceable along those brackets responsive to rotation of adjusting screws 68 which engage complementary apertures in the rear ends of the plates 64, the reed plates thereby being displaceable to correspond to the adjusted positions of the needle bars 54 and needles 58. The adjusted reed plates may be clamped in position on their respective brackets 66 by means of clamping screws 70 which are located in brackets and which pass through the slots of the reed plates.

Beneath the reed plates, there is arranged a looper mechanism including loopers 72 mounted in looper bars 73 which are adjustable along a carrier bar 74 actuated by a rocker shaft assembly 76, the loopers 72 being symmetrically arranged on either side of the rocker shaft assembly 76 and the looper bars 73 being securable by clamping screws 78 and clamping plates 80.

In use, the embodiment of the invention described with reference to FIG. 3 is adjusted by slackening the clamping screws 62 and 78. This permits the needle bars 54 and looper bars 73 respectively to be moved along their supports 50 and 74, the exact setting of a needle bar or of a looper bar and identical adjustments of the two being achieved by interposing a selected template block 55 or 75 between it and either the carrier member 52 or the rocker shaft assembly 76, as the case may be. The clamping screws are then tightened and appropriate adjustment is made of the positions of the reed plates 64 to accommodate the new settings of the needle bars and the loopers. The machine is then ready for use by conventional operation of the reciprocating mechanism 56 and of the yarn feed, which in FIG. 3 is omitted for clarity but which is similar to that diagrammatically shown in FIG. 1.

I claim:

1. A sliding needle bar tufting machine characterized by a pair of needle bars, a single row of needles carried by each needle bar, a pair of looper bars, a single row of loopers carried by each looper bar for co-operating with a respective one of said rows of needles, and means mounting said needle bars and said looper bars for adjustment of said bars in a warpwise direction thereby to permit corresponding warpwise adjustment of the spacing respectively between the two rows of needles and the two rows of loopers.

2. A tufting machine as set forth in claim 1, comprising a vertically reciprocable needle bar carrier in which one of said needle bars is slidably displaceable responsive to pattern requirements and support means on said one needle bar for mounting the other of said needle bars adjustably in a warpwise direction relative thereto.

3. A tufting machine as set forth in claim 2, wherein said needle bar support means comprise elongate cantilever members secured to said one needle bar and extending in a warpwise direction and a like number of screw clamp members on the other said needle bar, corresponding to and releasably engageable one on each of said cantilever members.

4. A tufting machine as set forth in claim 1, comprising a rocker shaft assembly for imparting a looping movement to one of said looper bars and support means on said one looper bar for mounting the other of said looper bars adjustably in a warpwise direction relative thereto.

5. A tufting machine as set forth in claim 4, wherein said looper bar support means comprise elongate cantilever members secured to said one looper bar, the other said looper bar being adjustably mounted on said cantilever members.

6. A tufting machine as set forth in claim 1, comprising a vertically reciprocable needle bar carrier, and a needle bar support member extending laterally from each side of said needle bar carrier and in a warpwise direction, with said needle bars adjustably mounted on said support member, one on each side of said needle bar carrier.

7. A tufting machine as set forth in claim 6, comprising suspension lugs on said needle bars for releasably engaging on said support member.

8. A tufting machine as set forth in claim 7, wherein the suspension lugs are formed integrally with the needle bars.

9. A tufting machine as set forth in claim 6 comprising a rocker shaft assembly having portions extending symmetrically on either side of said assembly, each of the looper bars being adjustably mounted on a respective one of said carrier bar portions for receiving a looping movement from said rocker shaft assembly.

* * * * *